US007086845B2

(12) United States Patent
Wong et al.

(10) Patent No.: US 7,086,845 B2
(45) Date of Patent: Aug. 8, 2006

(54) VANE PUMP HAVING AN ABRADABLE COATING ON THE ROTOR

(75) Inventors: Albert Cheuk-Yin Wong, Saginaw, MI (US); Tom Cheuk-In Wong, Saginaw, MI (US)

(73) Assignee: Delphi Technologies, Inc., Troy, MI (US)

( * ) Notice: Subject to any disclaimer, the term of this patent is extended or adjusted under 35 U.S.C. 154(b) by 545 days.

(21) Appl. No.: 10/349,945

(22) Filed: Jan. 23, 2003

(65) Prior Publication Data

US 2004/0146421 A1 Jul. 29, 2004

(51) Int. Cl.
*F04C 2/344* (2006.01)

(52) U.S. Cl. ..... 418/133; 418/178

(58) Field of Classification Search ..... 418/133, 418/178, 132, 235

See application file for complete search history.

(56) References Cited

U.S. PATENT DOCUMENTS

| | | | | | |
|---|---|---|---|---|---|
| 3,782,107 | A | * | 1/1974 | Bendall | 418/101 |
| 4,386,891 | A | | 6/1983 | Riefel et al. | |
| 4,923,377 | A | * | 5/1990 | Cavalleri | 418/144 |
| 6,050,796 | A | | 4/2000 | Wong et al. | 418/132 |
| 6,250,900 | B1 | * | 6/2001 | Gostomski | 418/178 |
| 6,364,630 | B1 | | 4/2002 | Craft et al. | 417/310 |
| 6,390,783 | B1 | | 5/2002 | Wong et al. | 417/53 |
| 6,422,845 | B1 | | 7/2002 | Wong et al. | 418/133 |
| 6,478,549 | B1 | | 11/2002 | Aden et al. | 417/310 |
| 6,481,990 | B1 | | 11/2002 | Wong et al. | 418/133 |
| 6,481,992 | B1 | | 11/2002 | Wong et al. | 418/133 |
| 6,497,557 | B1 | | 12/2002 | Aden et al. | 418/15 |

FOREIGN PATENT DOCUMENTS

| | | | | |
|---|---|---|---|---|
| DE | 2600972 | * | 3/1977 | 418/178 |
| GB | 234562 | | 6/1925 | |
| GB | 1289473 | * | 9/1972 | 418/178 |
| GB | 2140089 | | 11/1984 | |
| JP | 58067989 | | 4/1983 | |
| JP | 59213969 | | 12/1984 | |
| JP | 09088855 | | 3/1997 | |
| WO | 02/02949 | | 1/2002 | |

OTHER PUBLICATIONS

European Search Report dated Apr. 16, 2004 for EP Ser. No. 04075066.3.

* cited by examiner

*Primary Examiner*—Theresa Trieu
(74) *Attorney, Agent, or Firm*—Michael D. Smith

(57) ABSTRACT

A vane pump includes a cylindrical rotor rotatable inside of an oval-shaped rotor chamber of cam ring disposed between a pressed plate and a pressure plate. The rotor has opposite sides and a peripheral outer surface in which radial vane slots are formed and guide slideable vanes. The rotor is coated on its surfaces with a film of abradable coating material which reduces the operating clearance between the rotor and the thrust and pressure plates and cam ring so as to increase the volumetric efficiency of the pump.

3 Claims, 3 Drawing Sheets

VANE PUMP HAVING AN ABRADABLE COATING ON THE ROTOR

TECHNICAL FIELD

This invention relates to vane pumps.

BACKGROUND OF THE INVENTION

A vane pump typically includes a cylindrical rotor rotatable inside of an oval-shaped rotor chamber defined by a cam ring around the rotor. The cam ring and the rotor define a crescent-shaped cavity therebetween which is divided into a plurality of pump chambers by a corresponding plurality of flat vanes in radial vane slots in the rotor. The pump chambers expand in an inlet sector of the crescent-shaped cavity and collapse in a discharge sector of the crescent-shaped cavity as the rotor rotates. A thrust plate and a pressure plate on opposite sides of the cam ring cover the rotor chamber and are squeezed together by a plurality of hold-down springs or the like. Fluid in a discharge chamber of the vane pump and a discharge pressure reacts against the pressure plate to further clamp the cam ring between the pressure plate and the thrust plate. A significant fluid pressure differential across the pressure plate within an area defined by the silhouette of the rotor chamber induces flexure of the pressure plate into the rotor chamber. A clearance dimension between the thrust plate, the pressure plate and the rotor calculated to accommodate such flexure exceeds a corresponding clearance dimension calculated only to minimize friction between the thrust plate, the pressure plate and the rotor. Fluid leakage from the pump chamber is attributable to the extra clearance for flexure of the pressure plate reduces the volumetric efficiency of the vane pump. Even without such flexure, the presence of the operating clearance lends to a loss of volumetric efficiency of the pump due to fluid leakage.

It is an object of the present invention to improve the volumetric efficiency of vane pumps without impeding their operation.

SUMMARY OF THE INVENTION

A vane pump constructed according to the present invention comprises a pump housing having a thrust plate and a pressure plate disposed in the housing and having axially inner faces received between which is a cam ring with an inner cam wall defining a rotor chamber. A rotor is disposed in the rotor chamber for rotation relative to the cam wall and to the plates. The rotor has axially opposite faces adjacent the inner faces of the thrust and pressure plates and a peripheral surface adjacent the cam wall. The rotor is formed with a plurality of radial vane slots in which vanes are supported for radial reciprocation and communication with the inner cam wall of the cam ring. According to the invention, the opposite faces and peripheral surface of the rotor is coated with an abradable coating material.

One advantage of the present invention is that the abradable coating material applied to the rotor has the beneficial effect of reducing the effective operating clearance between the surfaces of the rotor and the adjacent surfaces of the thrust and pressure plates and cam ring. The coating material is applied to the rotor and, during initial operation, any excess attributed to high spots is abraded away, producing the least amount of clearance necessary between the rotor and the adjacent plates and cam ring needed to operate the pump, and consequently increasing the volumetric efficiency of the pump.

The invention has the further advantage of minimizing the effects of manufacturing tolerances from pump to pump. With application of the abradable coating to the rotor, the coating which effectively fills the excess gap that would otherwise be present due to tolerance differences. As such, whatever variations are present in any given vane pump, the abradable coating compensates by reducing clearances where necessary and abrading away in areas where the full thickness of the coating is not needed in order to provide each pump with the optimum minimum operating clearance for maximum volumetric efficiency.

The invention has the further advantage of enabling the abradable coating to be applied to one component, namely the rotor, and having the effect of reducing the effective operating clearance between several components, namely the rotor, thrust plate, pressure plate and cam ring. However, the coating could be applied to one or more of the other components as well.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
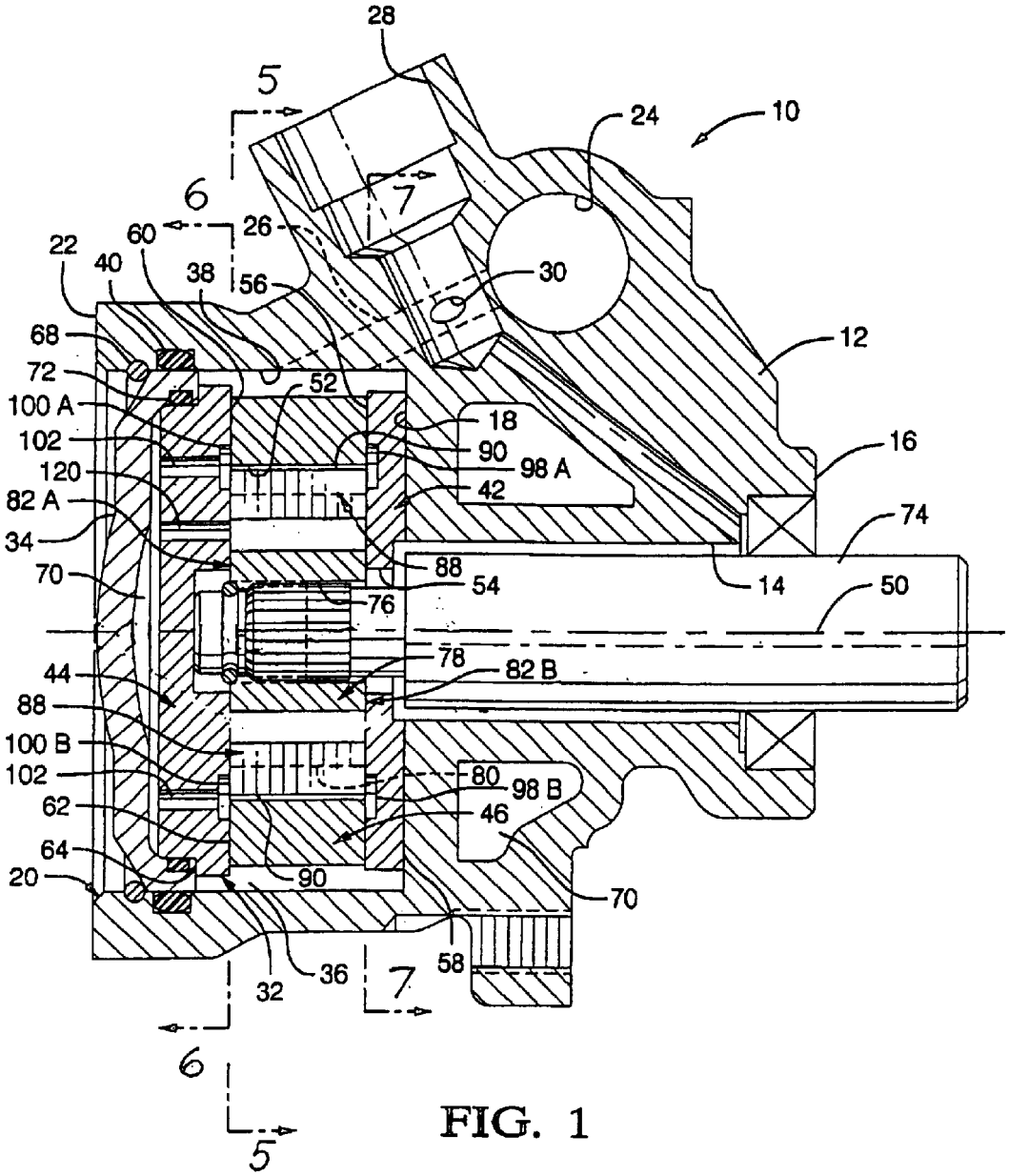
FIG. 1 is a longitudinal sectional view of a vane pump according to this invention.

A vane pump constructed according to a presently preferred embodiment of the invention is shown generally at 10 in the drawings and includes a housing 12 having a drive shaft bore 14 open through a first end 16 and intersecting a flat bottom 18 of a large counter bore 20 in a second end 22 of the housing. A control valve bore 24 in the housing 12 communicates with the counter bore 20 through a schematically represented internal passage 26 in the housing. An inlet passage 28 in the housing communicates with a reservoir of fluid (not shown) and with the internal passage 26 through an aperture 30.

A "rotating group" 32 of the vane pump 10 is captured in the counter bore 20 between the flat bottom 18 and a disc-shaped cover 34, closing the open end of the counter bore. An annular chamber 36 is defined between a cylindrical side wall 38 of the counter bore 20 and the rotating group 32. A seal ring 40 suppresses fluid leakage between the housing 12 and the cover 34. The rotating group 32 is stationary relative to the pump housing and includes a thrust plate 42 seated on the flat bottom 18 of the counter bore 20, a pressure plate 44, and a cam ring 46 between the thrust plate and the pressure plate. A plurality of dowel pins traverse the pressure plate, the thrust plate, the cam ring and the housing and prevent relative rotation therebetween about a longitudinal center line 50 of the vane pump.

The cam ring 46 has an oval-shaped inner cam wall 52 facing the longitudinal center line 50. The thrust plate 42 has an aperture 54 over the drive shaft bore 14 where the bore intersects the flat bottom 18 of the counter bore 20 and a planar inner face 56 facing and bearing against an end 58 of the cam ring 46. The pressure plate 44 has a planar inner side 60 facing and bearing against an end 62 of cam ring and an annular shoulder 64 on which the cover 34 is seated. The oval-shaped cam wall 52 and the planar sides 56, 60 of the thrust plate and pressure plate cooperate in defining a generally oval-shaped rotor chamber 66 of the rotating group 32.

The cover 34 compresses the rotating group 32 against the flat bottom 18 of the counter bore 20 to seal the rotor chamber 66 against fluid leakage between the planar side 66 of the thrust plate and the end 58 of the cam ring, and between the planar side 60 of the pressure plate and the end 62 of the cam ring 46. A retaining ring 68 prevents dislodgement of the cover 34 from the cylindrical counter bore 20. A discharge chamber 70 of the vane pump is defined between the cover 34 and the pressure plate 44 and within the housing 12 around the drive shaft bore 14. A seal ring 72 suppresses fluid leakage between the cover 34 in the pressure plate 44.

A drive shaft 74 is supported on the pump housing for rotation about the longitudinal center line 50. A splined inboard end of the drive shaft cooperates with the splined bore 76 in a rotor 78 disposed in the rotor chamber 66 and couples the shaft 74 and rotor 78 for unitary rotation about the longitudinal center line 50. An outboard end (not shown) of the drive shaft 74 is coupled to a source of power, such as a motor of a motor vehicle, when the vane pump 10 constitutes a source of pressurized fluid for a steering assist fluid motor on a motor vehicle.

Figure 4:
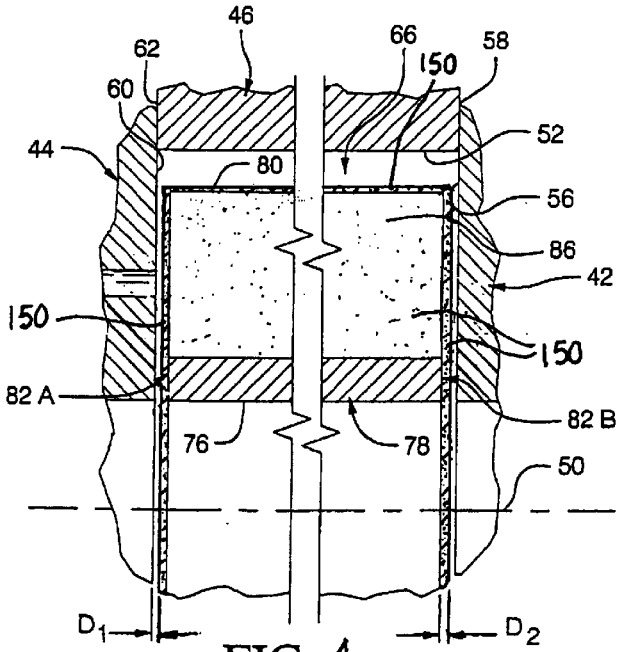
FIG. 4 is an enlarged fragmentary sectional view of the pump.

The rotor 78 has a cylindrical outer peripheral surface 80 which is symmetric with respect to the longitudinal center line 50 of the pump, and a pair of axially opposite end walls or faces 82*a*, 82*b* in planes perpendicular to the longitudinal center line 50. The end walls 82*a*, 82*b* of the rotor 78 are separated from the planar sides 60, 56 of the pressure plate 44 and pressed plate 42 by respective ones of a pair of clearance dimensions $D_1$, $D_2$, as best shown in FIG. 4. The outer surface 80 of the rotor 78 cooperates with the oval-shaped cam wall 52 of the cam ring 46 in defining a pair of crescent-shaped cavities 84*a*, 84*b* in the rotor chamber 66 on opposite sides of the rotor 78, as shown best in FIG. 5.

A plurality of radial vane slots 86 are formed in the rotor 78 and intersect the outer surface 80 and each of the end walls 82*a*, 82*b* of the rotor 78. A corresponding plurality of flat vanes 88 are supported in respective ones of the vane slots 86 for radial reciprocation. Each flat vane 88 has an outboard lateral edge 90 bearing against the oval-shaped wall 52 of the cam ring 46 and a pair of radial edges 92 separated from respective ones of the planar sides 60, 56 of the pressure plate and the thrust plate by the clearance dimension $D_1$, $D_2$. The vanes 88 divide the crescent-shaped cavities 84a, 84b into a plurality of pump chambers 93 which expand in each of a pair of diagonally opposite inlets sectors of the crescent-shaped cavities and collapse in each of a pair of diagonally opposite discharge sectors of the crescent-shaped cavities in conventional fashion concurrent with rotation of the rotors 78.

The thrust plate 42 has a pair of diametrically opposite notches 94*a*, 94*b* open to the annular chamber 36. The pressure plate 44 has a pair of diametrically opposite notches 96*a*, 96*b* open to the annular chamber 36. The notches 94*a*, 96*a* and the thrust plate and the pressure plate are angularly aligned with the inlet sector of the crescent-shaped cavity 84 and define a first inlet port of the vane pump. Similarly, the notches 94*b*, 96*b* in the thrust plate and the pressure plate are angularly aligned with the inlet sector of the crescent-shaped cavity 84 and define a second inlet port of the vane pump.

Figure 6:
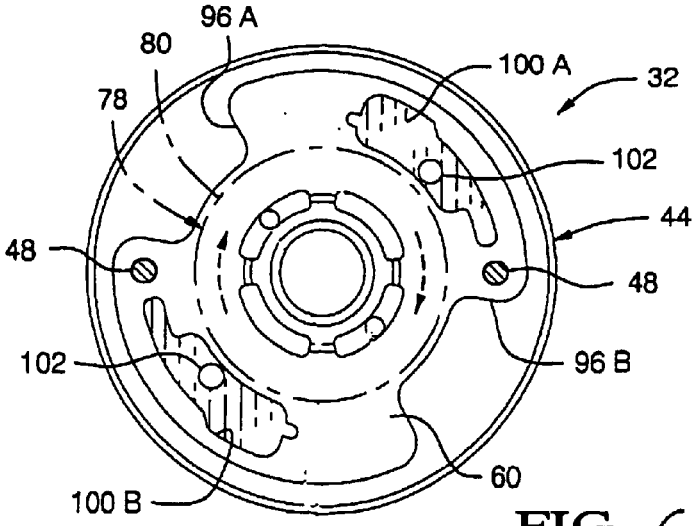
FIG. 6 is a sectional view taken severally along lines 6—6 of FIG. 1.
Figure 5:
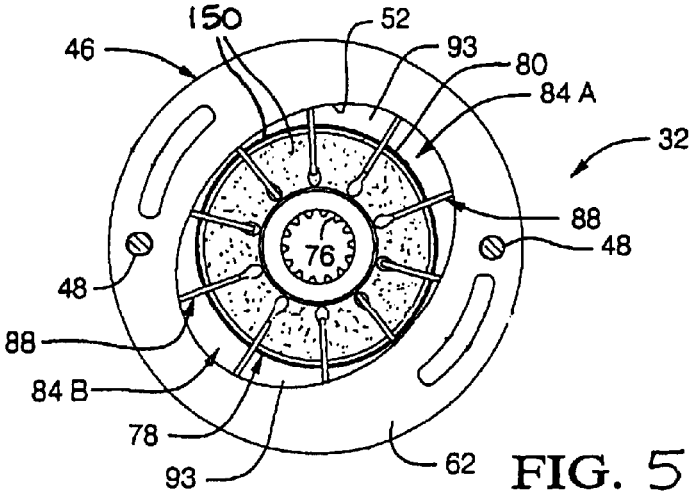
FIG. 5 is a sectional view taken severally along lines 5—5 of FIG. 1.
Figure 7:
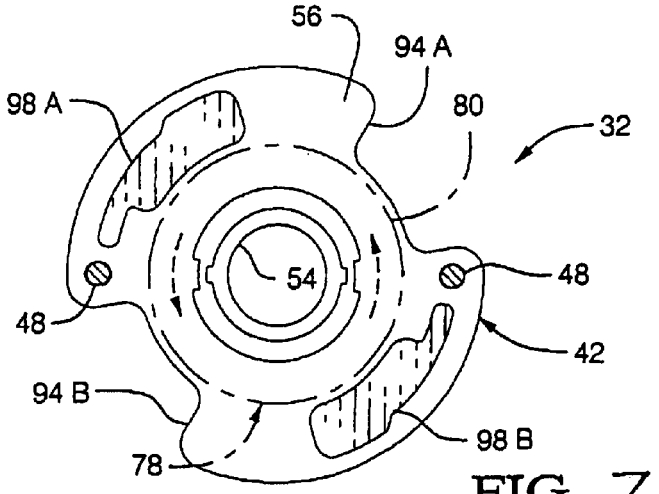
FIG. 7 is a sectional view taken generally along lines 7—7 of FIG. 1.

The thrust plate 42 has a pair of diametrically opposite shallow grooves 98*a*, 98*b* in the planar side 56 thereof. The pressure plate 44 has a pair of diametrically opposite shallow grooves 100*a*, 100*b* in the planar side 60 thereof. The grooves 98*a*, 100*a* in the thrust plate and pressure plate are angularly aligned with the discharge sector of the crescent-shaped cavity 84*a*. The grooves 98*b*, 100*b* in the thrust plate and pressure plate are angularly aligned with the discharge sector of the crescent-shaped cavity 84*b*. The grooves 100*a*, 100*b* communicate with the discharge chamber 70 through a pair of schematically represented passages 102 in the pressure plate, as illustrated best in FIG. 6, and define respective ones of a pair of discharge ports in the vane pump. The grooves 98*a*, 98*b* in the thrust plate communicate with the shallow grooves 100*a*, 100*b* in the pressure plate through a pair of slots 104 formed in the cam ring 46, as illustrated in FIG. 5. The discharge chamber 70 communicates with an external device, such as the aforementioned steering assist fluid motor, through a discharge passage (not shown) in the pump housing 12.

Figure 2:
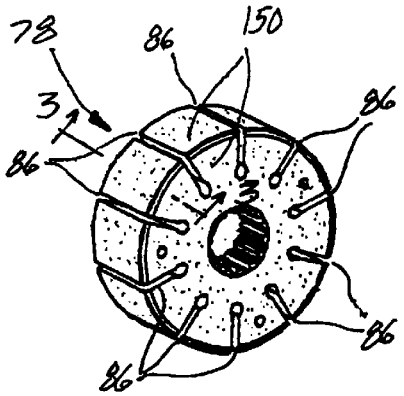
FIG. 2 is a perspective view of a rotor fabricated according to the invention.
Figure 3:
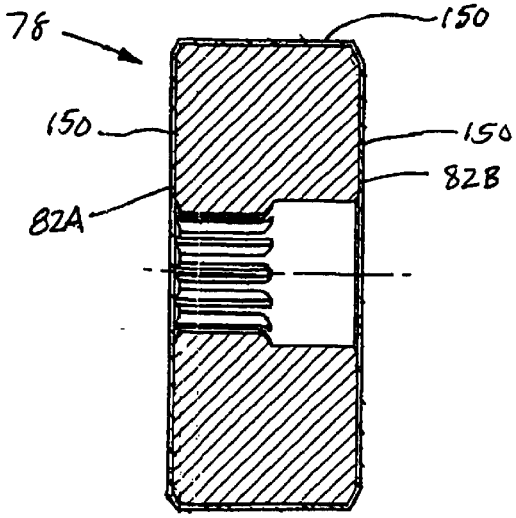
FIG. 3 is a cross-sectional view taken generally along lines 3—3 of FIG. 2.

As shown best in FIGS. 2, 3, and 4, the rotor 46 is coated on its opposite faces 82*a*, 82*b*, outer peripheral surface 80 and, preferably but optionally within the vane slots 86 with a film 150 of abradable coating material. The film 150 is fabricated of a material different than that of the rotor 78. The film 150 is bonded to the mentioned surfaces of the rotor 78 which, when the rotor 78 is rotated relative to the thrust plate 42, pressure plate 44 and cam ring 46 causes any "high spots" of the film 150 as initially applied and installed which contact the adjacent surfaces of the stationary components to abrade and wear off of the rotor 78 to the point where the coated surfaces of the rotor 78 rotate just slightly out of contact with the adjacent stationary components, thereby minimizing the operational gap or clearance between the rotor 78, the thrust end pressure plates 42, 44, and the cam ring 46. Operating clearance achievably by use of the abradable coating are in the range of 0.0000" to 0.0004", which is far smaller than the typical clearance using non-coated rotors of 0.0008" to 0.0012". By reducing the operating clearance of the rotor, the volumetric efficiency and seizure resistance of the pump 10 is greatly increased over a comparable pump having an uncoated rotor.

The abradable coating material 150 preferably comprises a manganese-iron phosphate film applied at a uniform film thickness of about 0.174 to 0.198 mils as a preferred range, with a broader operational range ranging from 0.117 mils to less than 0.3 mils. Outside of this range, any appreciable range in volumetric efficiency is lost and in fact in some cases there can be a loss of volumetric efficiency when the coating is too thick. Two types of manganese-iron phosphate coatings have shown to perform adequately with the invention. One is General Motors materials specification GM4277M, and the other is General Motors material specification GM7818506, the published specifications of which are incorporated herein by reference. The materials are applied to the rotor 78 as a thin film in the thickness range specified above by a reaction of the rotor surfaces in a chemical bath prepared and operated according to the specification. Optionally, but not necessarily, the surfaces of the stationary components, namely the pressure and thrust plates 42, 44 as well as the cam ring 46 can be coated with the same or different abradable material to the same or different thickness in lieu of or in addition to the rotor 78, although it is preferred that only the rotor be coated. Studies conducted on comparable pumps with coated versus uncoated rotors show an improvement in volumetric efficiency by as much as 40 percent due to the presence of the abradable coating 150 on the surfaces of the rotor 78.

The two specific coating compositions which have been found to be particularly advantageous are comprised by weight of per area manganese-iron phosphate (1,000–1,400 $mg/ft^2$) and manganese-iron phosphate with Endurian® (1,450–1,900 $mg/ft^2$) on test panels. The invention contemplates that other abradable coating compositions could be used and could increase the volumetric efficiency of a rotary pump more or less than that of the two coatings described above.

The vane pump 10 operates substantially as described in prior U.S. Pat. No. 6,050,796, the disclosure of which is incorporated herein by reference.

Obviously, many modifications and variation of the present invention are possible in light of the above teachings. It is, therefore, to be understood that within the scope of the appended claims, the invention may be practiced otherwise than as specifically described. The invention is defined by the claims.

We claim:

1. A vane pump comprising:

a pump housing having a longitudinal axis;

a thrust plate disposed in said housing having an axially inner face;

a pressure plate disposed in said housing in axially spaced relation to said thrust plate and having an axially inner face;

a cam ring disposed in said housing between said plates and having an inner cam wall;

a rotor supported within said cam ring for rotation relative to said cam ring and said plates, said rotor having axially opposite surfaces adjacent said axially inner faces of said plates and an outer peripheral surface adjacent said inner cam wall of said cam ring;

a plurality of vanes slideably supported within associated radial vane slots of said rotor for radial reciprocation in communication with said inner cam wall during rotation of said rotor; and an abradable coating material applied to said axially opposite and outer peripheral surfaces of said rotor adjacent said inner faces of said plates and said cam surface of said cam ring, and wherein said plates and said cam ring are free of said coating material.

2. The vane pump of claim 1 wherein said vane slots are free of said coating material.

3. The vane pump of claim 1 wherein said coating material is applied to said vane slots of said rotor.

* * * * *